US012352070B2

(12) United States Patent
Barnes

(10) Patent No.: US 12,352,070 B2
(45) Date of Patent: Jul. 8, 2025

(54) POOL SKIMMING SYSTEM

(71) Applicant: Stephan Barnes, Rogers, AR (US)

(72) Inventor: Stephan Barnes, Rogers, AR (US)

( * ) Notice: Subject to any disclaimer, the term of this patent is extended or adjusted under 35 U.S.C. 154(b) by 471 days.

(21) Appl. No.: 17/952,436

(22) Filed: Sep. 26, 2022

(65) Prior Publication Data

US 2023/0012547 A1 Jan. 19, 2023

(51) Int. Cl.
*E04H 4/12* (2006.01)

(52) U.S. Cl.
CPC ..... *E04H 4/1263* (2013.01)

(58) Field of Classification Search
CPC ..... E04H 4/1263
USPC ..... 210/167.1, 167.19, 167.2
See application file for complete search history.

(56) References Cited

U.S. PATENT DOCUMENTS 4,212,740 A * 7/1980 Greene ..... E04H 4/1272 210/242.1
6,716,342 B1 * 4/2004 Tilsner ..... E04H 4/1272 210/232
8,864,986 B1 * 10/2014 Smith ..... E04H 4/1272 210/232
9,581,478 B1 * 2/2017 Smith ..... E04H 4/1272
10,526,808 B2 * 1/2020 Smith ..... C02F 1/001
2009/0159516 A1 * 6/2009 Andrei ..... E04H 4/1272 210/167.12
2015/0354242 A1 * 12/2015 Saccoccio ..... B01D 29/50 210/806
2021/0172188 A1 * 6/2021 Afshar ..... E04H 4/1281

* cited by examiner

*Primary Examiner* — Fred Prince

(74) *Attorney, Agent, or Firm* — Chris Tanner; FYPA PLLC

(57) ABSTRACT

A system and method for improving the capture-rate and efficacy of a pool skimming infrastructure is disclosed, having a basket, a floating skimmer contained therein, and a rim. The floating skimmer has two or more louvres located on an exterior thereof. The louvres on the floating skimmer correspond with a plurality of slots within the basket. During use, the basket will remain stationary, but the floating skimmer will float-travel along a vertical axis defined by the slots. The skimmer system thus enables effective skimming regardless of potential changes in level of the pool water.

20 Claims, 19 Drawing Sheets

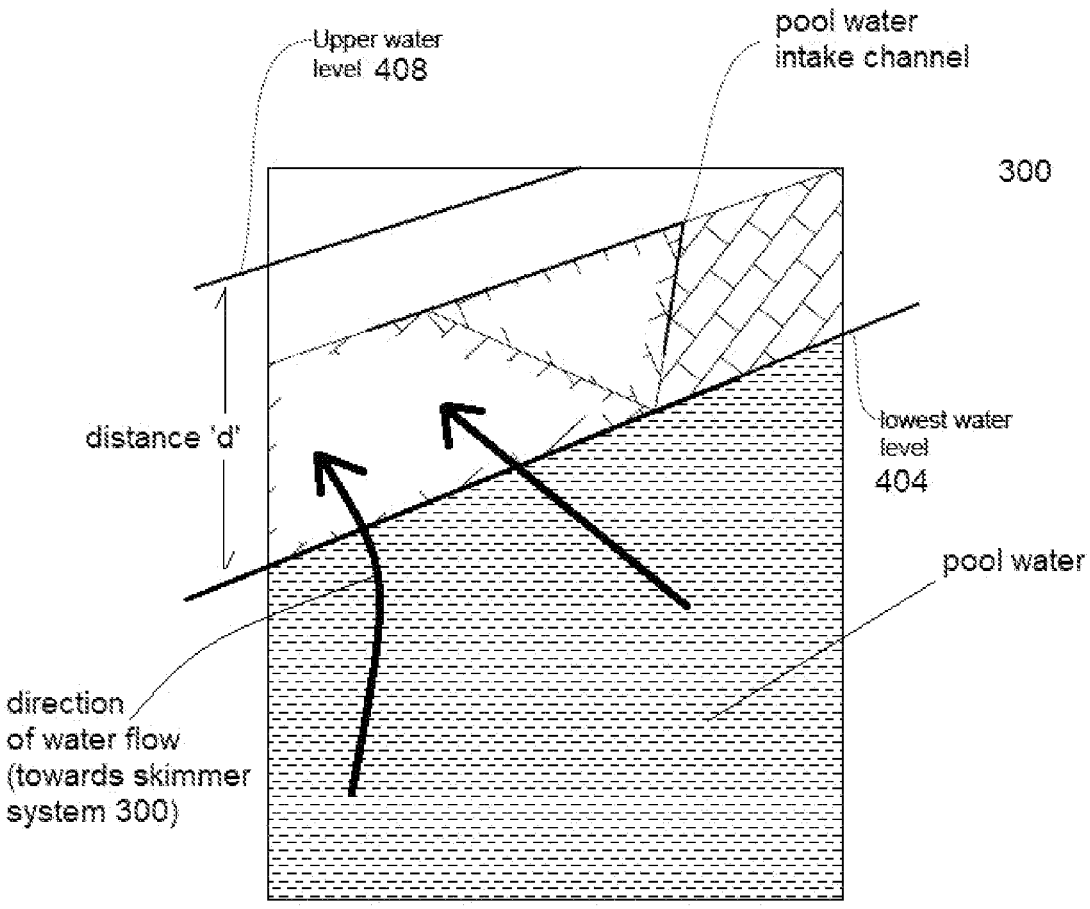
FIG. 4 (pool water levels and operating range)

REPLACEMENT DRAWING 17/952,436

POOL SKIMMING SYSTEM

BACKGROUND

A typical swimming pool is equipped with at least two filtering mechanisms. A first mechanism is the filter mechanism and pump, which strives to filter all the water in the pool, top to bottom. The other mechanism is a skimmer or skimming infrastructure that is more targeted at just the top surface of the water. That is, targeted only at the debris still-floating on the surface of the pool water. The intent of the skimmer mechanism is to more quickly capture this surface debris, right away, preferably before it becomes water-logged and is still somewhat lighter, and before it sinks to the bottom of the pool.

In most pools, unwanted debris starts out as mere surface debris, and it's a lot better to try to remove it from the surface, before it sinks. Once any debris sinks to the bottom of a pool, the debris is much harder to recover, and the typical pump and filter mechanisms may not ever recover it. Instead, it may become necessary to vacuum or scrape or otherwise manually capture the sunken debris.

Additionally, when a serious amount of rainfall occurs within an outdoor pool, a key function/feature of a conventional skimming infrastructure is defeated. If the conventional skimming infrastructure is submerged, by e.g. 1 or 2 inches of additional water, its ability to perform surface-skimming is lost. When a conventional skimming infrastructure becomes submerged, debris may come near it but only by accident, and will likely just float away and not be captured.

A similar problem occurs if the water-level goes below the level of the conventional skimmer. In such a case, no water is skimmed. Consequently, a mechanism for improving the capture-rate and efficacy of a pool skimming infrastructure is desired.

BRIEF DESCRIPTION OF THE DRAWINGS

FIGS. 3-4 show an embodiment of a skimmer system;

DETAILED DESCRIPTION OF PREFERRED EMBODIMENTS

Figure 1:
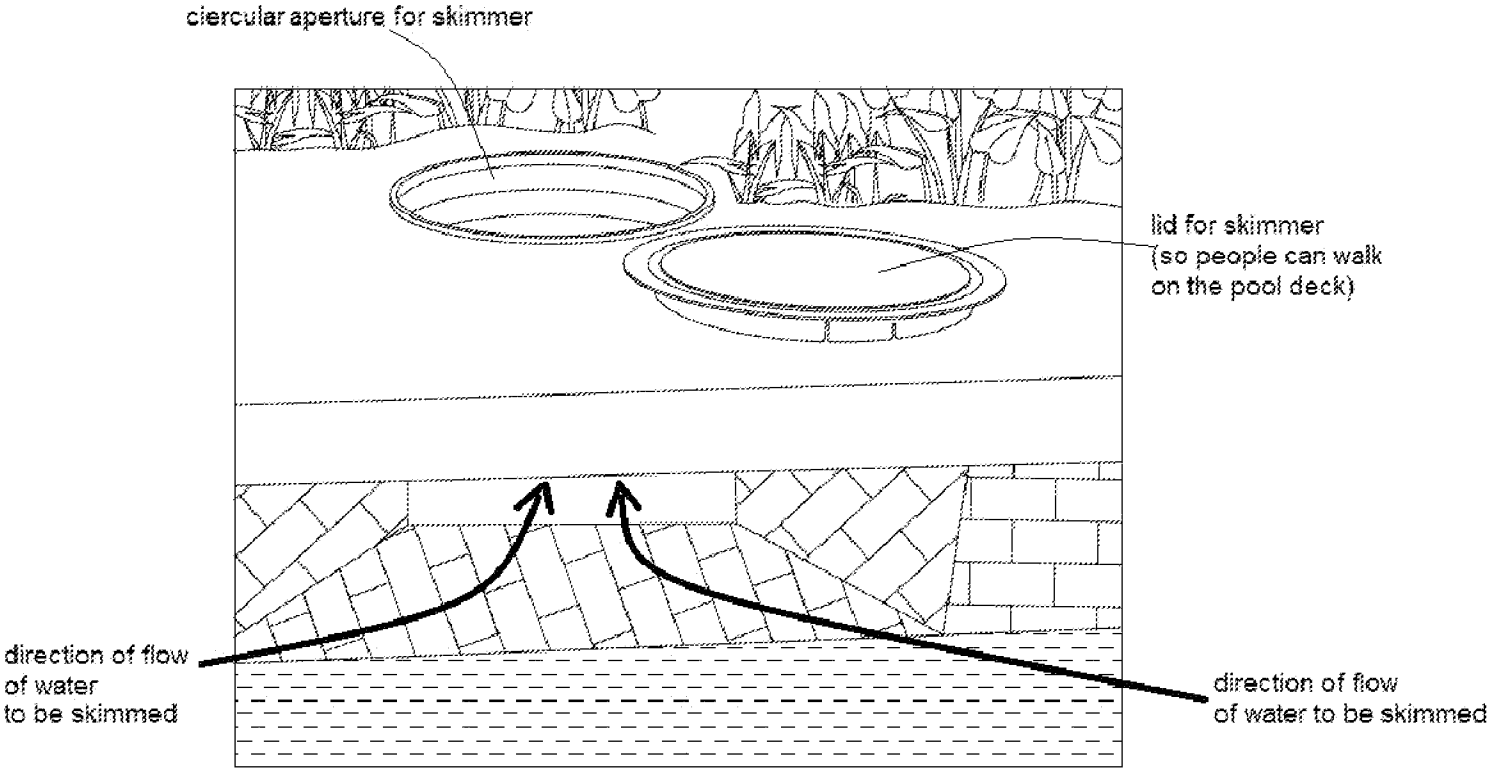
FIG. 1 (prior art)
FIGS. 1-2 (Prior Art) show a conventional pool skimming infrastructure.
Figure 2:
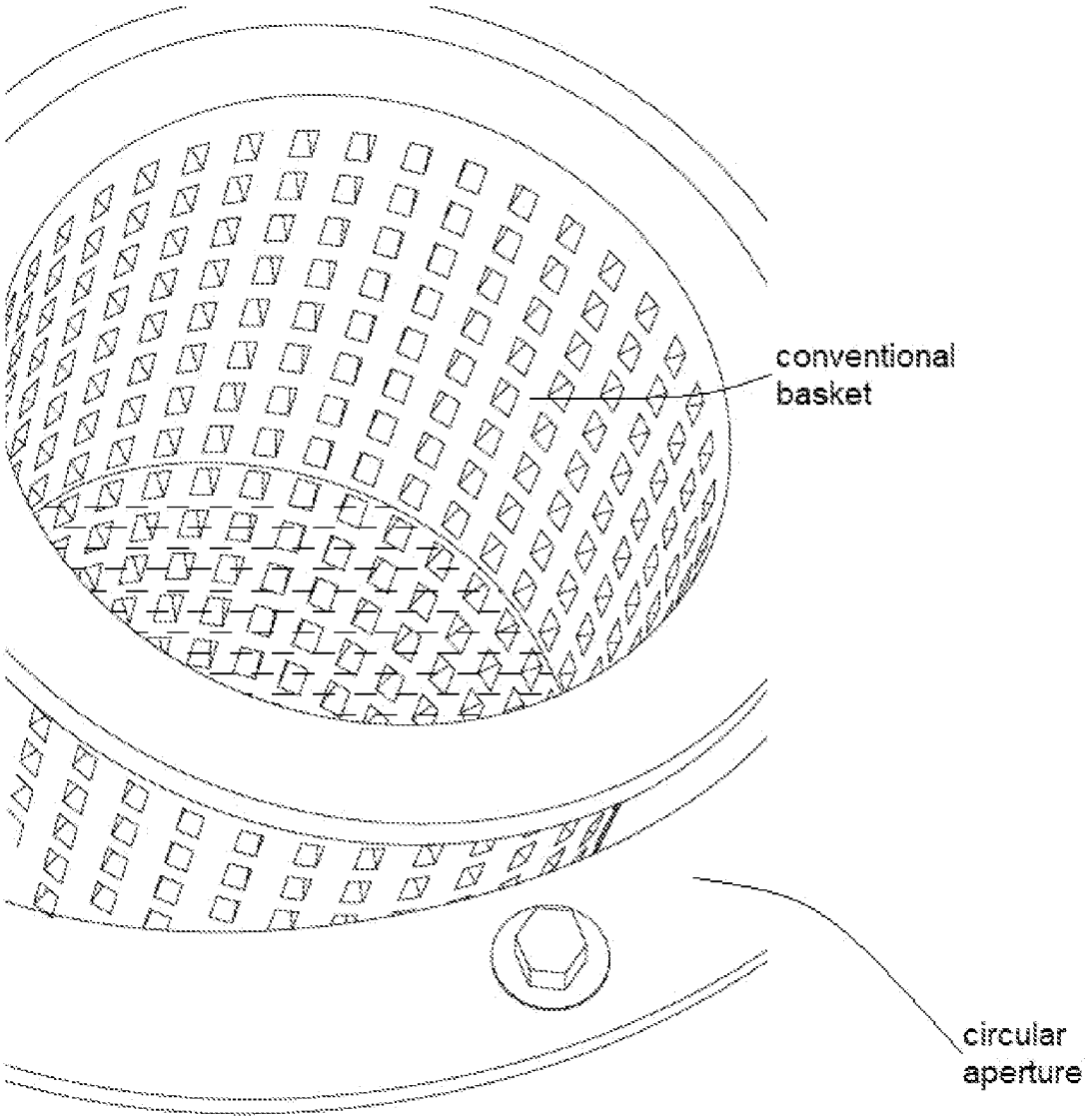
FIG. 2 (Prior Art)

A typical pool skimming infrastructure is shown in FIGS. 1-2 (Prior Art). The embodiments herein will work effectively within any pool having a conventional skimming infrastructure. Typically, a conventional skimming infrastructure comes in one of only two sizes.

For convenient reference, FIG. 2 show a Prior Art stationary basket being inserted and removed from a circular aperture typical of a conventional skimming system. In such a conventional stationary skimming mechanism, pool water (and debris) stream through the Prior Art basket via suction, which directs the pool water into and through the conventional skimmer basket.

As stated, a conventional skimmer mechanism is easily defeated by just a bit of rain. Once the water level rises about the water-line, the skimming basket will not catch anything. Its only necessary to raise the water level by an inch or so to make a conventional pool skimmer cease being effective.

Figure 3:
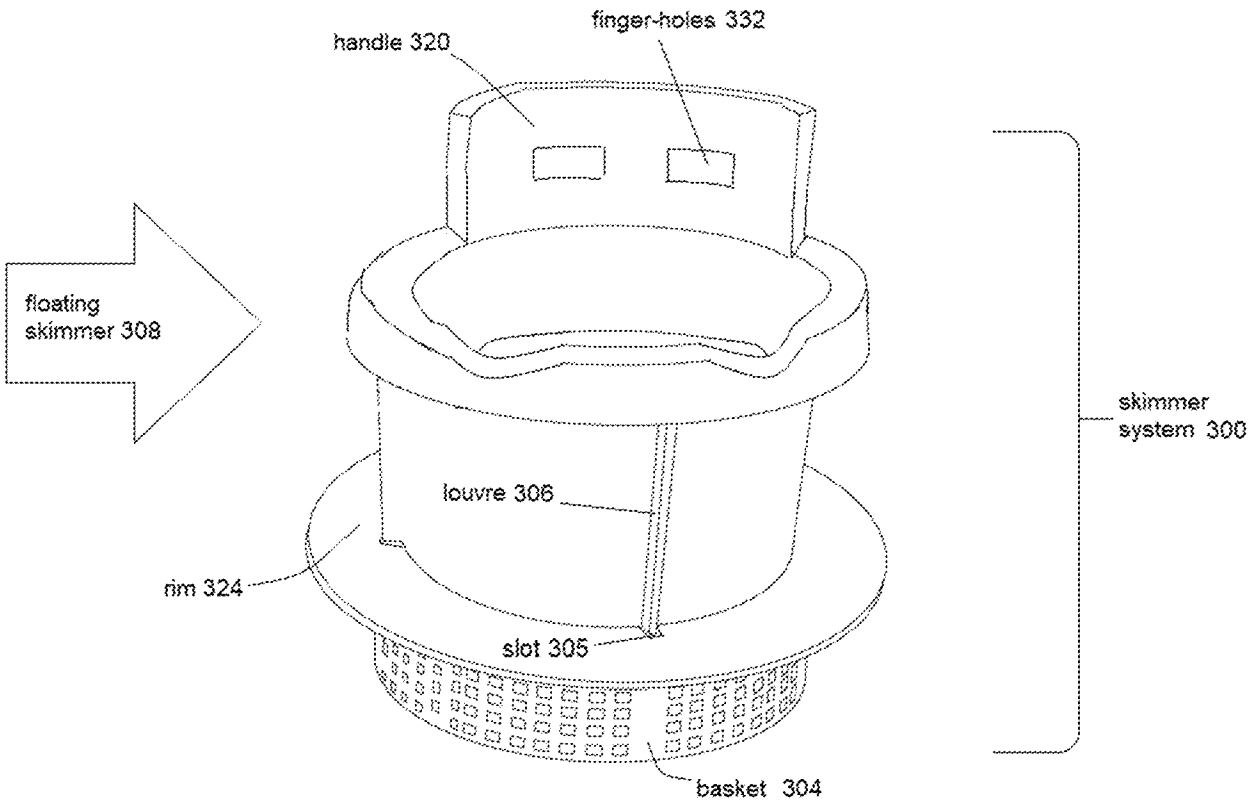

To address these and other issues, FIGS. 3-4 show an embodiment of an improved skimmer system 300, comprising a basket 304 and a floating skimmer 308, where the floating skimmer 308 has two or more louvres 306 defined therein. During use, the basket 304 will likely remain stationary, but the floating skimmer 308 will float-travel along a vertical axis defined by the louvres 306. Accordingly, using the skimmer system 300 enables effective skimming regardless of potential changes in level of the pool water, as shown at least within FIG. 4. The louvres 306 within the floating skimmer 308 correspond with a plurality of slots 305 within the basket 304.

Specifically, as the floating skimmer 308 goes up and down traveling inside of the slots 305, the rim 324 of the floating skimmer 308 is always near to or at the same level as the surface of the pool water, within a foreseeable range spanning a significant distance 'd' (see FIG. 4). This in turn reinforces the principle that the skimmer system 300 is functional and on-duty a much larger percentage of the time than conventional skimmer systems, which spend a considerable amount of time out of action and non-helpful because they are unable to adjust to changes in water-levels. This is because conventional skimmers have very minimal distance of vertical travel.

Further, the cost of pool chemicals has escalated. This includes stabilizer. The improvements provided by the embodiments herein result in decreased need for pool chemicals. The surface debris is trapped and removed and the water remains less tainted, resulting in less need to neutralize debris through chemical treatment.

Assembly of the System 300

There are mainly only two known sizes of apertures (into which the system 300 is inserted). The system 300 comprises three main pieces (basket 304, floating skimmer 308, and rim 324) but ships with 4 pieces (two unequal rims 324), to give an end-purchaser a guaranteed solution.

As such, one possible end-consumer packaging method is to include two differently-sized snap-on rims 324 that surround the basket 304, where those different sizes are chosen to match with the two common sizes of skimming infrastructure aperture. These snap-on rims 324 have some minimal cost. Still, packaging/shipping an end-solution with both ensures that the end-purchaser will have the correct size during installation of the skimmer system 300 into almost any basket-aperture. This accommodates as many user\purchasers as possible. Although some cost-loss occurs by including one non-fitting rim 324 (of the pair), the gain in packaging and shipping is more than advantageous.

Figure 5A:
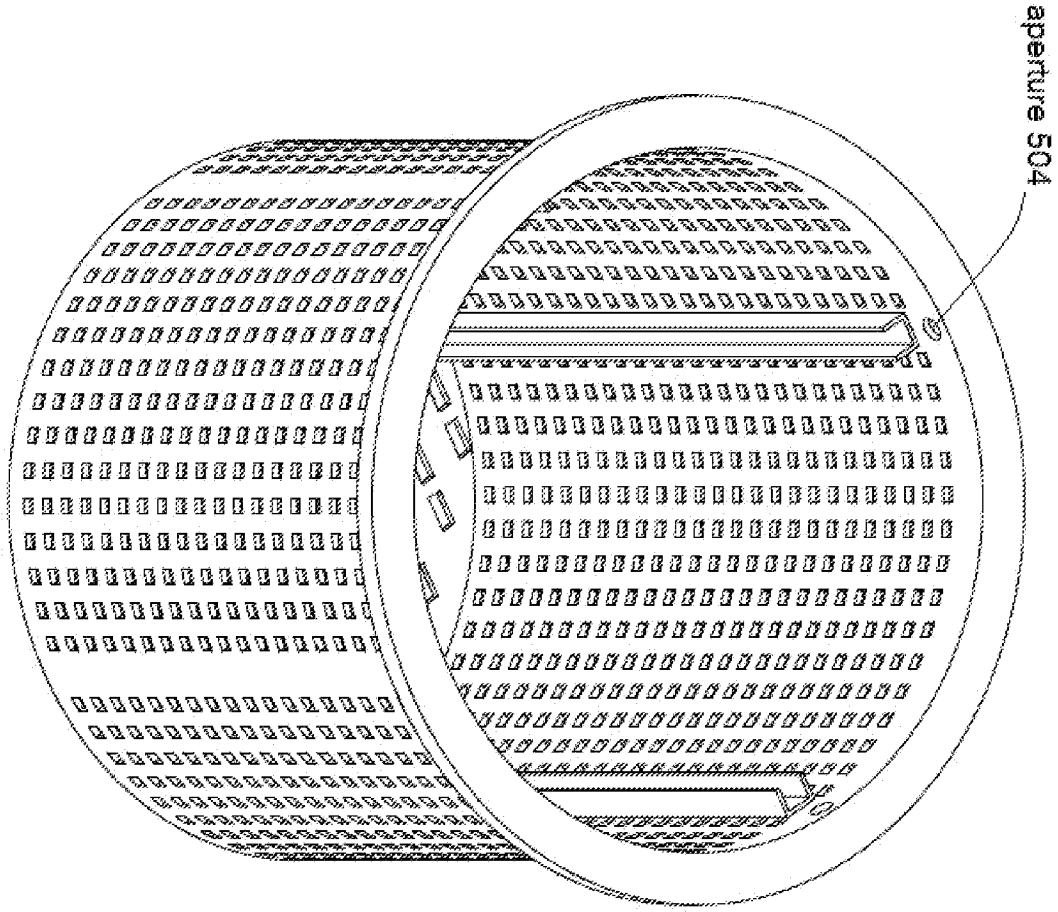
FIGS. 5A, 5B, and 5C show a rim attached to a basket, according to an embodiment.
Figure 5B:
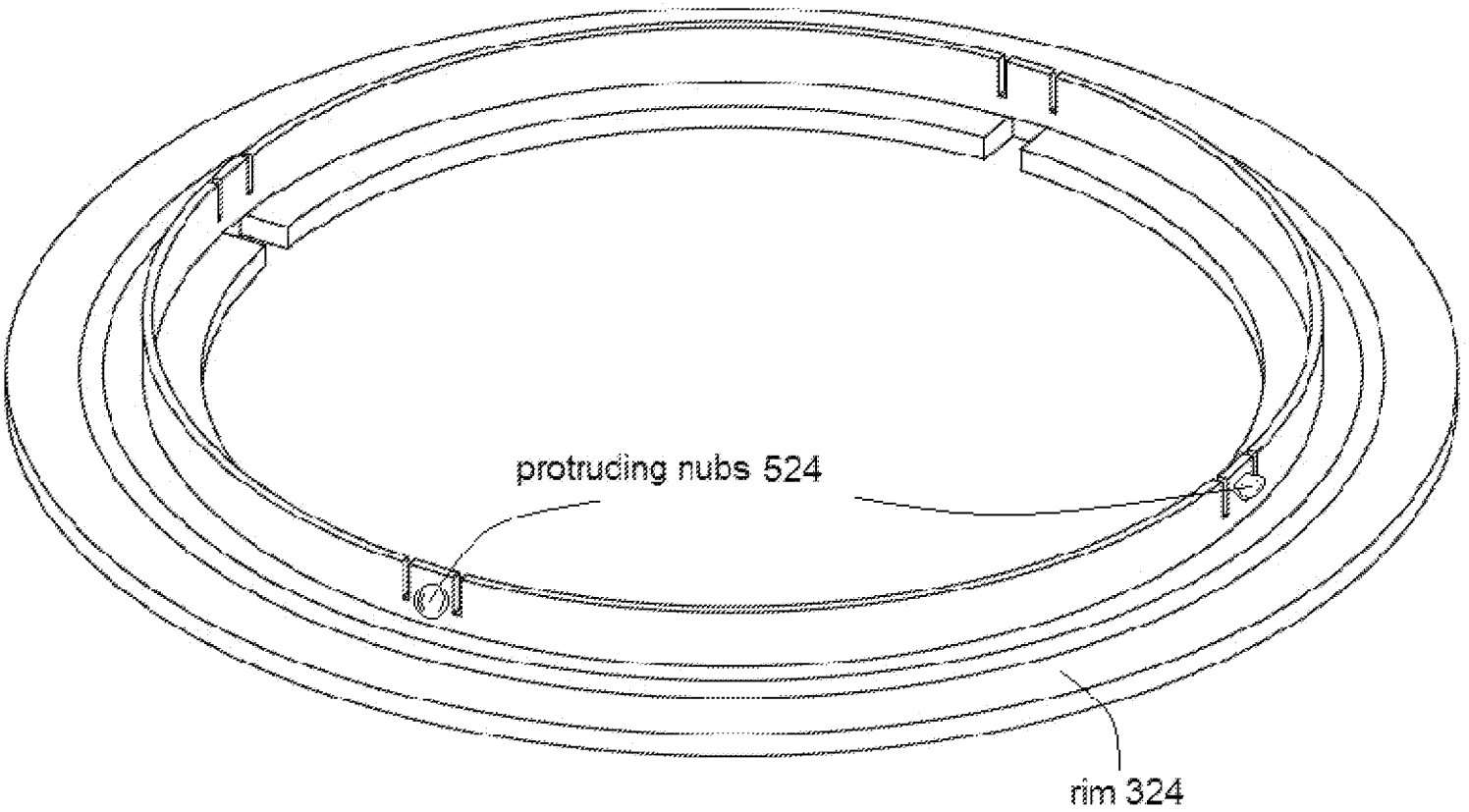
Figure 5C:
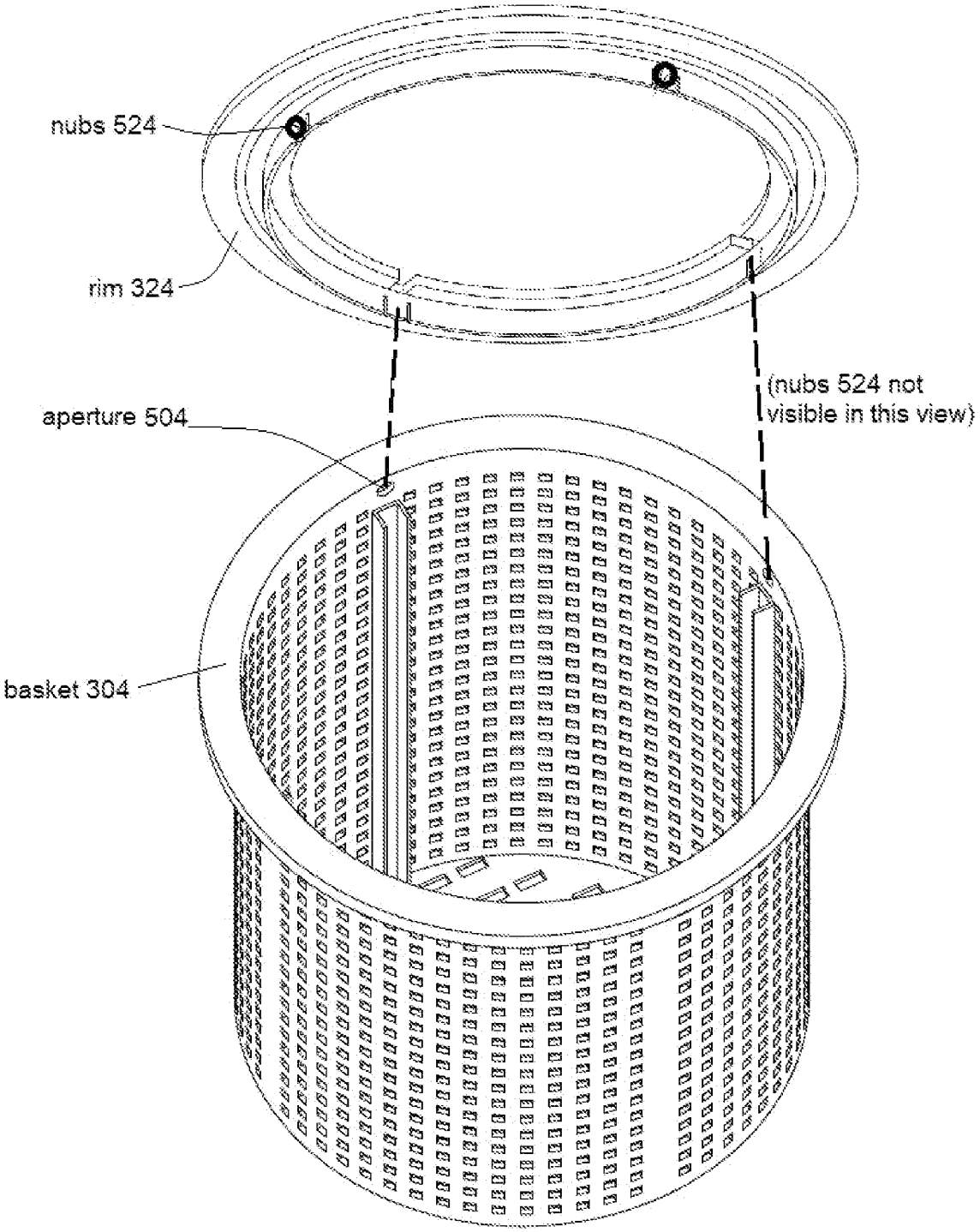

As shown in FIGS. 5A-5C the rim 324 attaches to the basket 304. For shipping convenience, the rim 324 is attached by the end-user. Or, the rim 324 can be sold pre-attached. One plan is to sell/package the system 300 with the two rims 324 so that the entire package is more universal. An end customer would merely discard the non-fitting rim 324.

FIGS. 5B-5C show protruding nubs 524 on the rim 324. Meanwhile, FIGS. 5A and 5C shows the basket 304 equipped with apertures 504. As shown in FIG. 5C, the rim 324 is fastened to the basket 304 by matching the protruding nubs 524 with the apertures 504, such that the rim 324 "snaps into place" on the basket 304.

Figure 5D:
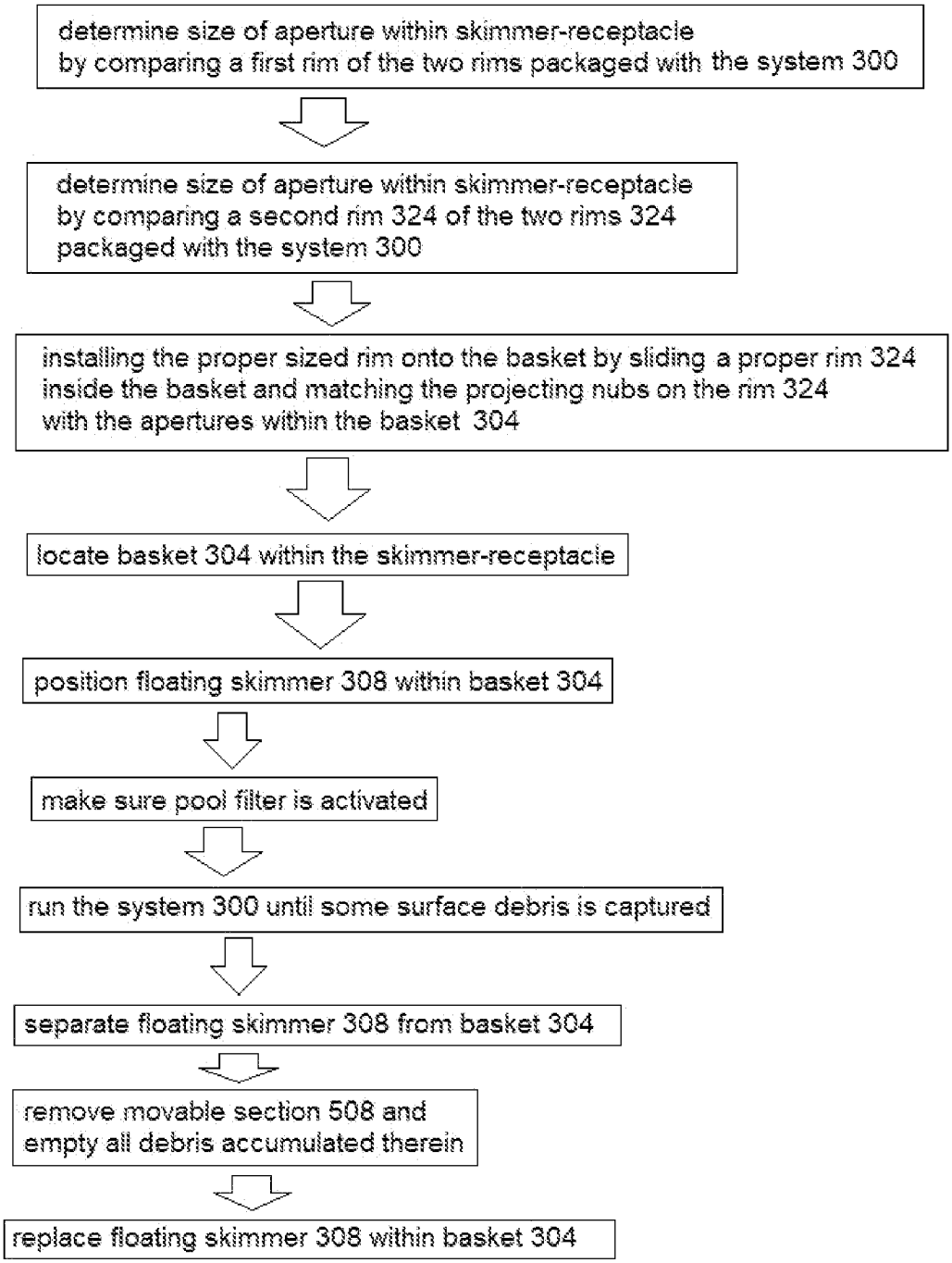
FIG. 5D is a flowchart showing an example method of assembling and installing the system.

FIG. 5D is a flowchart showing an example method of assembling and installing the system 300.

Floating Skimmer 308

The basket 304 (stationary) material can be made of non-buoyant PVC with a specific gravity above 1.3. This causes the basket 304 to comfortably sink, yet not impede the free-floating nature of the floating skimmer 308. In an embodiment, the floating skimmer 308 comprises a material differing from that which comprises the basket 304. The floating skimmer 308 could comprise a material that has positive buoyancy. One example is polypropylene, but a specific type of polypropylene that has as specific gravity below 0.92, such as polypropylene copolymer or homopolymer.

In any case, either the composition of the floating skimmer 308, or the air chambers 704 within the skimmer, or both, help the floating skimmer 308 remain buoyant. This property in turn also assists in preventing the floating skimmer 308 from binding or sticking to the basket 304.

Another advantage is situations where the pump is entirely turned off, where debris may be present in the floating skimmer 308, but where the user has not emptied out the floating skimmer. This may happen when the owner is away, at work, pre-occupied with other tasks, or other kinds of circumstances. The buoyancy of the floating skimmer 308 remains effective in all conditions and all circumstances. Power on, power off, pump on, pump off, doesn't matter.

Thus, in a situation where the floating skimmer 308 has retained some debris, but the pool is idle, or the pump is off, the permanent-buoyant nature of the floating skimmer 308 means that any debris therein is more likely to remain inside, until the user can empty out the floating skimmer 308.

Installation of the System 300

During installation of the system 300, a user would first position the basket 304 within the bottom of any (existing) circular aperture (see FIG. 2) which normally houses a pool skimmer. To properly install the system 300, a user must first make sure that the basket 304 is properly fitted into the circular aperture using the rim 324, including first determining the proper rim-size (see FIG. 5D). Then, the user takes the movable section 308 and loads it in on top of the basket 304. In doing so, the user should ensure the louvres 306 match up with the slots 305 in the basket 304.

Use of the System 300

During use of the system 300, when pool water is being pumped, a specific type of enhanced water-flow (vacuum) is created partly by the flow channels 316 within the floating skimmer 308. The system 500 is adaptable to have a variety of numbers of flow channels 316, in a variety of shapes, depending on the needs of a specific pool.

The design of the system 300 ensures that some portion of the water flowing through it travels downward at a high rate, thereby trapping debris and achieving full soak of the debris, such that it drops to the bottom of the basket, and does not flow back out. Some of this is of course caused by the water-pump which is part of a typical pool arrangement. However, another effect is that a flow-effect is created, such that the floating skimmer 308 is not pulled down by the water pump. Instead, the composition of the floating skimmer 308 ensures its buoyancy and floating more effectively, thereby staying level with the surface of the water.

Increased water-flow advancement occurs partly by pool water sometimes sloshing and flowing behind the handle 320, which then travels through the finger holes 332 and downward through the floating skimmer 308. Debris will seldom flow through the finger holes, but the water flow through the finger holes 332 will help drive debris downward and trap it within the floating skimmer 308.

Surface debris tends to seep just over the edge of the floating skimmer 308 because of the welcoming invitation by the flow channels 316. Then, the surface debris is further retained within the floating skimmer 308 partly due to the downward force provided by the supplemental water flowing through the finger holes 332. In any case, once the surface debris flows into the floating skimmer 308, the surface debris may flow out temporarily due to sloshing, but eventually will be captured. Within the embodiments herein, surface debris flows in, but does not flow out (or only flows out temporarily), and instead is captured.

The intent of the system 300 is to capture surface debris while it has specific gravity lower than water, lower than 1.0, meaning while the surface debris still floats. Once any debris is sufficiently soaked, it sinks, IOW develops a specific gravity above 1.0. The system 300 does not have any significant role in non-surface debris.

Flow Channels 316

FIGS. 6A, 6B, 6C, 6D, 6E, and 6F show the flow channels 316, which are designed to accelerate water flow and improve skimming efficiency. The flow channels 316 are shown with a specific contour in FIGS. 6A-6B, but this is for illustration only and should not be considered limiting.

Figure 6A:
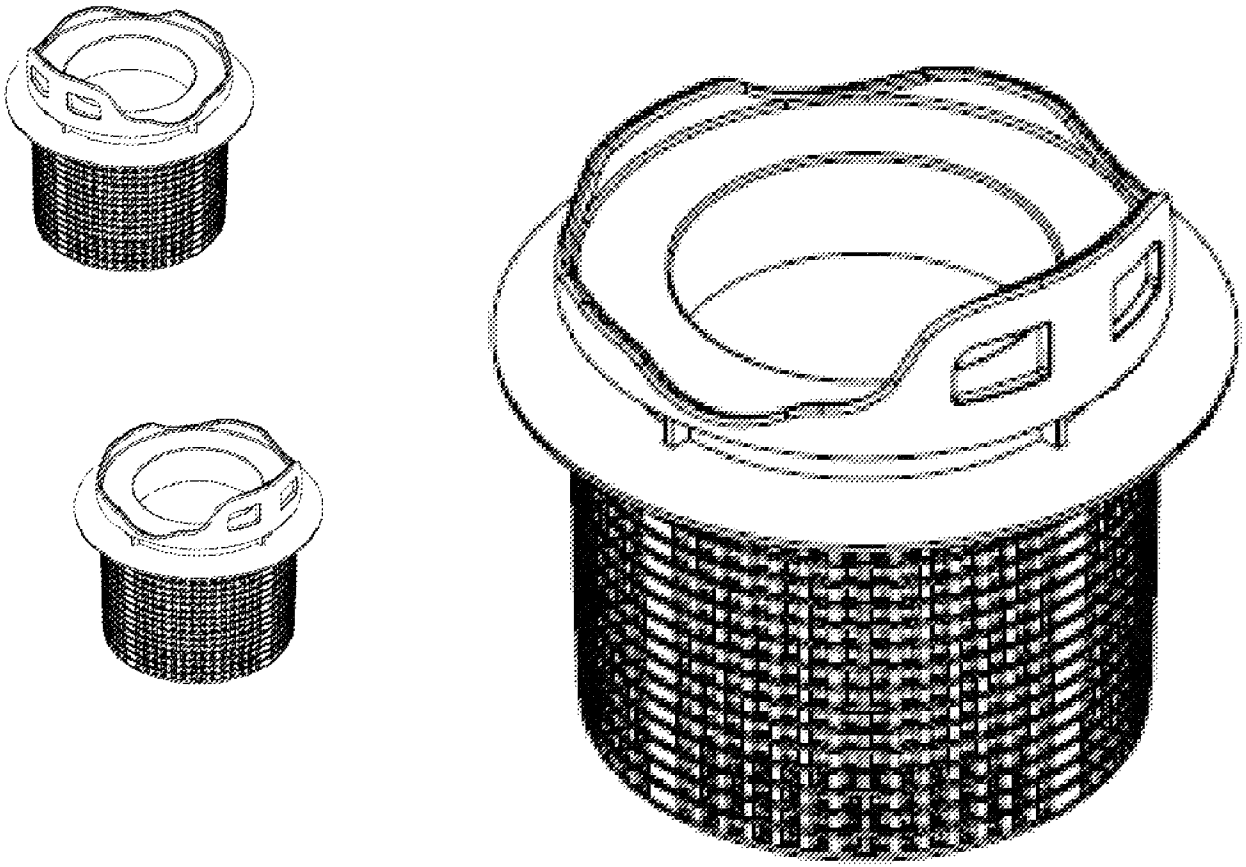
FIGS. 6A, 6B, 6C, 6D, 6E, and 6F show various features of the flow channels.
Figure 6B:
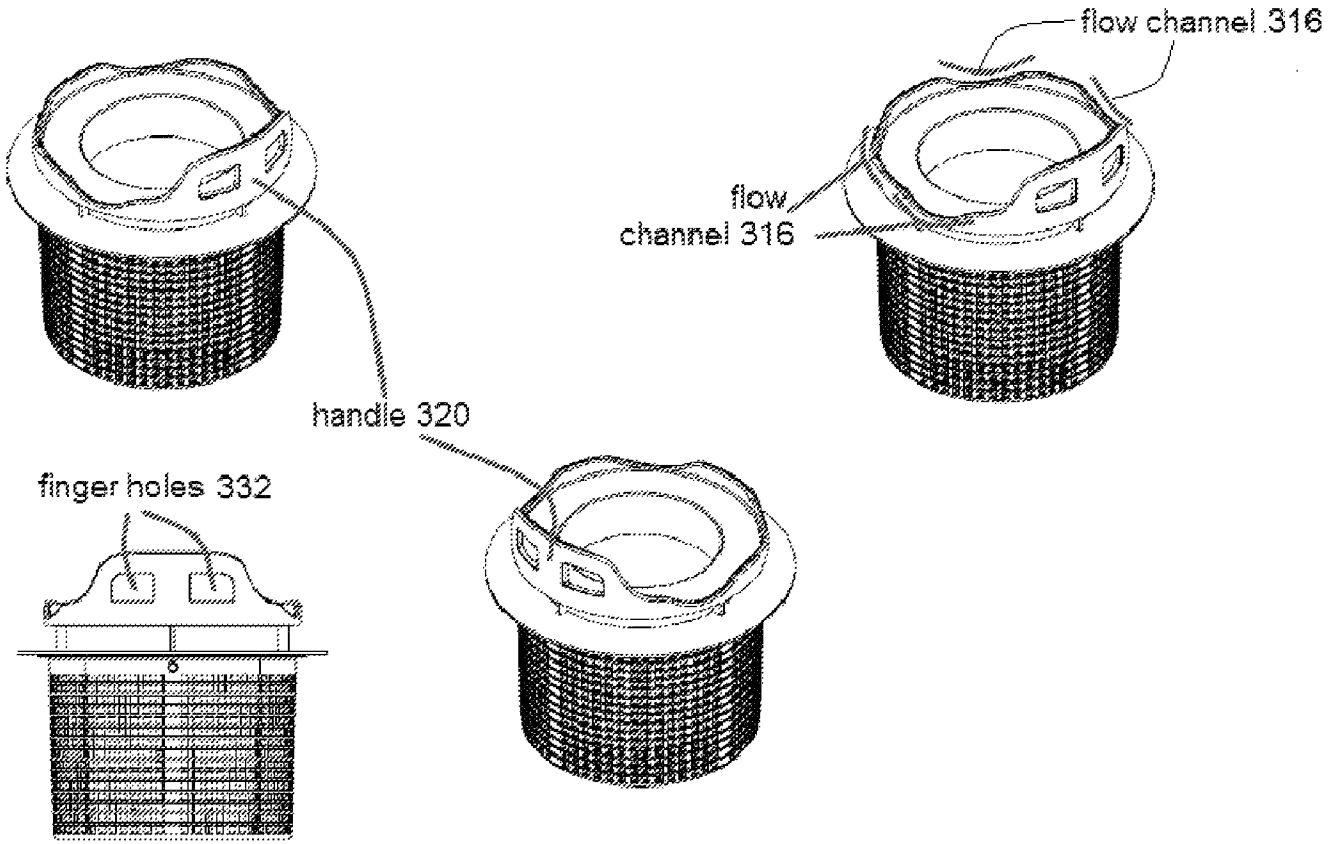
Figure 6C:
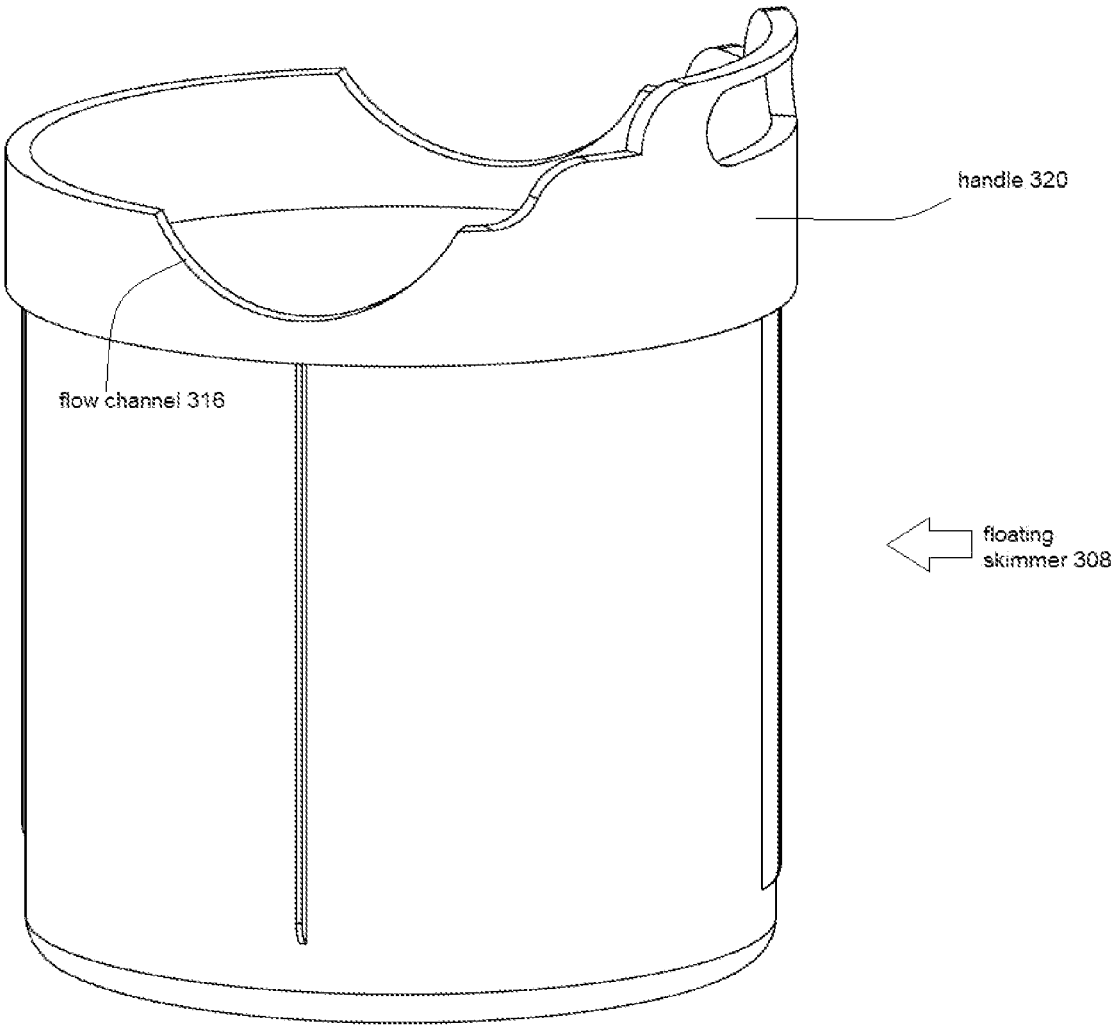
Figure 6D:
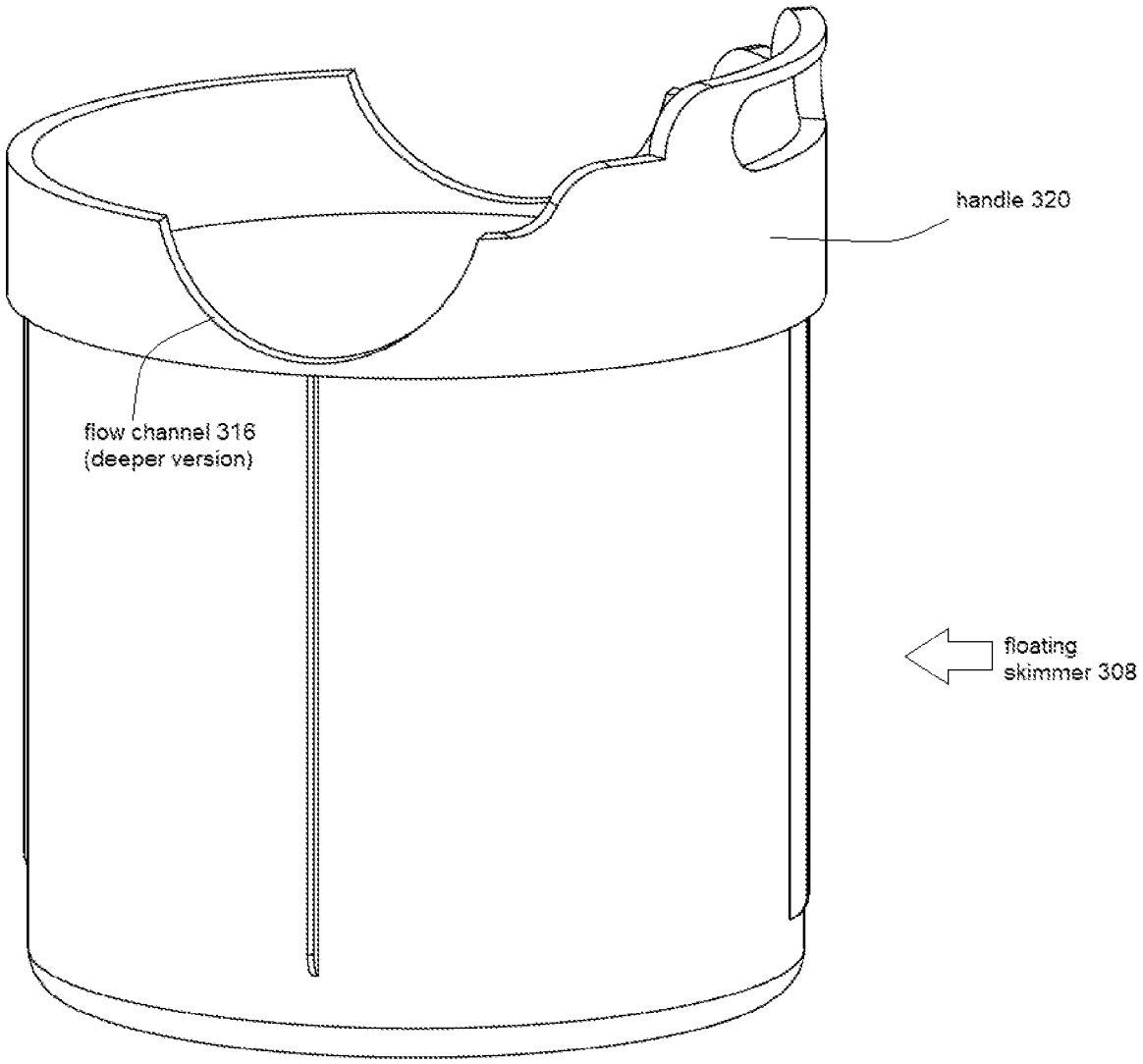
Figure 6E:
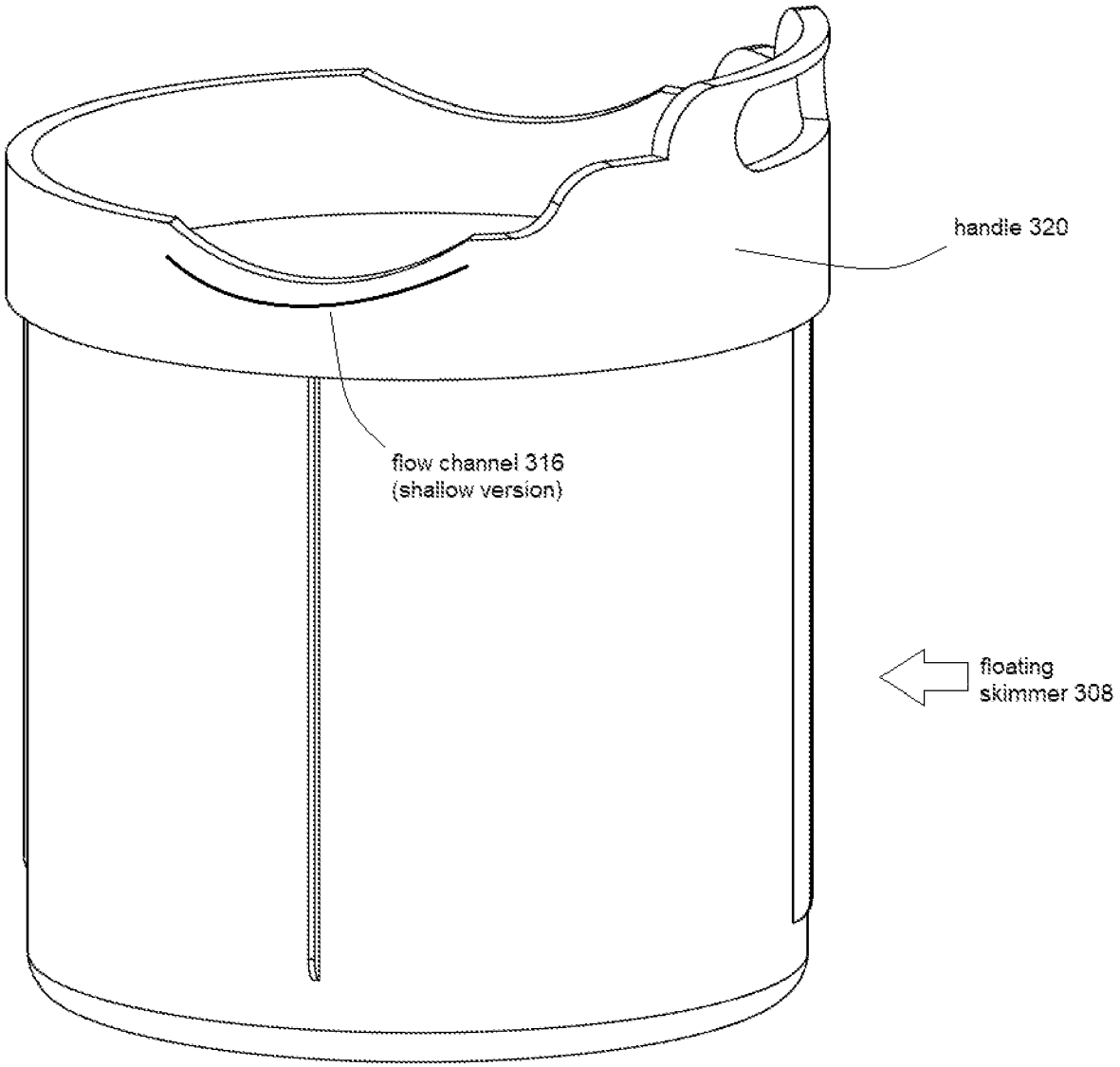

FIGS. 6A and 6B show the floating skimmer 308 having four flow-channels 316. However, the sizes, shapes, and numbers of the flow channels 316 can be other than what is shown herein. Also, a distance between the finger-holes 332 and the rim 324 can vary from what is shown, as well as the size, shape, and contour of the handle 320.

A contour (lip) of an upper-surface of the flow channels 316 can be changed in order to adapt to various surface debris. The flow channels 316 can be adapted and re-contoured in order to adapt to changing conditions, changes in season, changes in nearby trees, changes in prevalence of flying insects, and other factors that contribute to floating debris in a pool. This includes optimizing the system 300 to accept pine needles (that always float, that don't sink, that always remain buoyant), leaves that curl, leaves that remain flat, insects, and even cosmetic make-up.

Figure 6F:
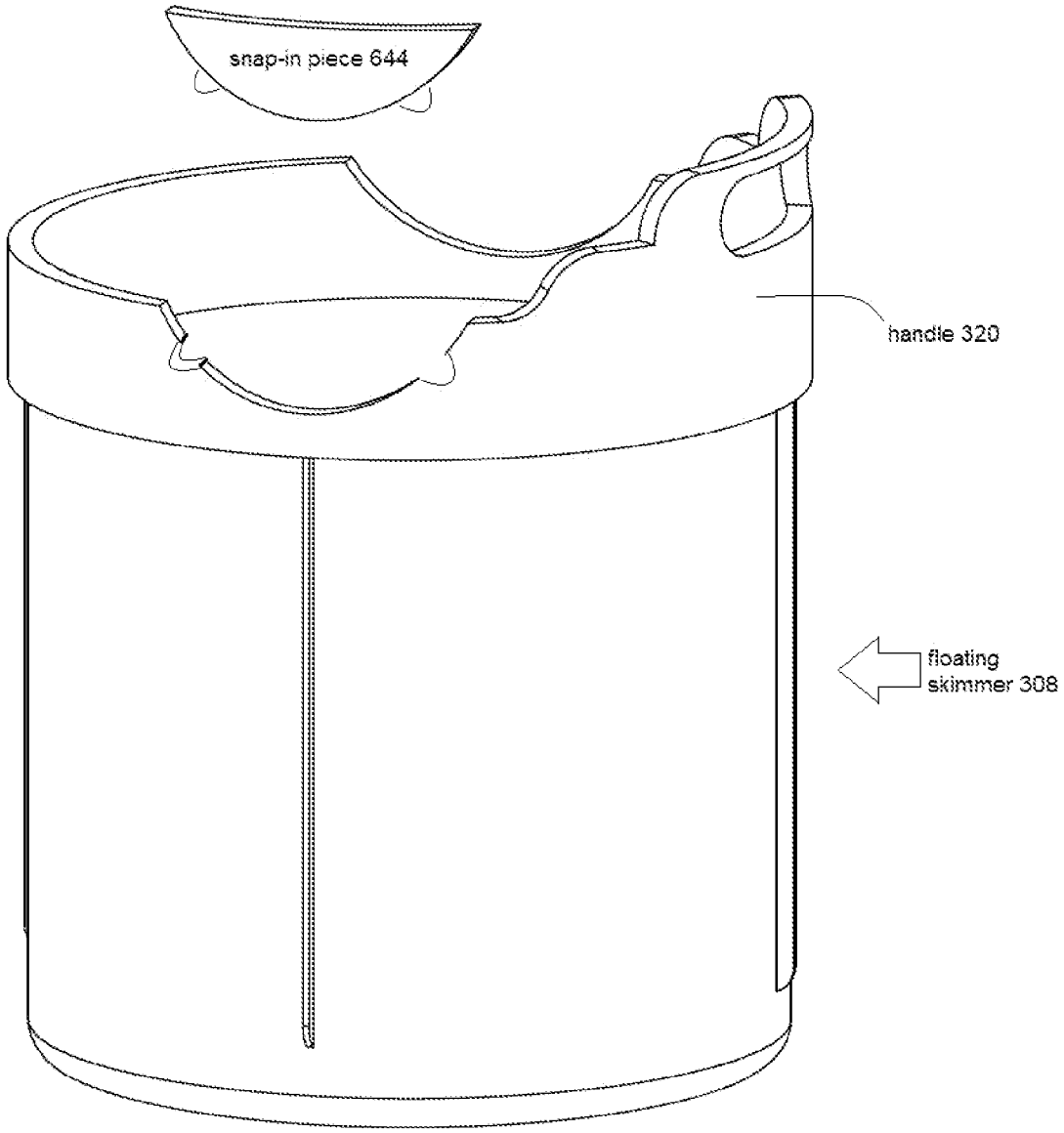

The flow channels 316 can be circular, elliptical, and other shapes. The flow channels 316 can have inserts for removing a bevel entirely, via a snap-in piece 644 (FIG. 6F). The floating skimmer 308 can accommodate collapsing or removing an upper surface, changing an angle of a vertical surface within the flow channels 316, including potentially some moving or non-rigid surfaces e.g. a loose or flapping lip either on the flow channel 316 or the vertical surfaces therebetween.

Various of the flow channels 316 can also be adjusted to take advantage of pool currents that occur due to closeness with or relationship to boundary walls (edges of pool). Various of the flow channels 316 can also be removed or replaced, again to take advantage of pool currents that occur due to closeness with or relationship to boundary walls (edges of pool). Further, the system 300 can be placed into the circular aperture at any of 4 different positions, such that the handle can face the pool interior, face the pool exterior, or otherwise.

Testing, Adapting, User Configuring of System 300

A user can experiment and test the system 300, and then re-configure the system 300 according to their preferences. The system 300 provides a variety of user-configurable features, comprising:

customization of contour of flow-channels 316;

snap-in inserts that can block a flow-channel 316; and/or 4 separate orientations for positioning the system 300, based on whether the handle 320 faces north, south, east, or west.

In general, the system 300 is self-adjusting and does not need much configuring. However, for those motivated purchaser/users of the system 300, who may have special circumstances or "pet peeves" of certain kinds of floating debris, the system 300 provides options and ways to experiment, to see if there are ways to capture higher percentages of specific floating debris.

One way to perform these tests is to gather a large group of whichever annoying debris is causing problems. Whether its leaves of a certain size, pine needles, or some other substance, a user can grab a big pile of these. Then, set up the system 300 in a first configuration, with known orientations of the handle 300 and known configurations of the flow channels 316. Then, random-scatter a known quantity of the pine needles or other test-debris. Watch how quickly (or slowly) the system 300 reacts to this debris. Then, remove the debris, make alterations to the handle-orientation, and to the flow channels 316. Then, a user can throw in a second volley of known quantity of debris, and review performance of the system 300 for any change either up or down.

Another quick way to get a quick indication of skimming effectiveness is by throwing in a known quantity of ping pong balls. Observe how quickly these are captured.

Another factor to consider in testing/using the system 300 is the location of the skimming circular aperture in the body of the pool, with respect to any nearby interior walls or special architectural features which may result in eddy currents or unusual speeds or directional-flows of water. Such unusual circumstances may affect how water flows past the circular aperture, but somehow does not induce floating debris to be attracted to the filtering mechanisms. In such a case, it may be helpful to shut off or eliminate certain flow channels 316, or make those flow channels 316 wider or deeper.

The good news is, a visual test can be achieved such that an observer can obtain valid objective data about what works and what does not. Then, a user can adjust the system 300 according to that data.

It is well-known that a sloshing effect causers randomness in both directions, both toward and away from the system 300. As such, a testing period should last long enough to account for this sloshing, and average out over time. Further, the best results will occur by doing testing while the pool is both static/unoccupied and also occupied.

The main point is that the system 300 has some ability to be customized, to be configured, according to a user's specific preferences. Sometimes, optimizing for these specific performances can involve experimentation and testing.

Methods of Manufacture

During manufacturing, if the slots 305 are made too narrow, the louvres 306 might stick and inhibit vertical movement. Meanwhile, if the slots 305 are too wide, the louvres 306 could be subject to strong horizontal forces and not freely move vertically, so that the overall system 300 could be impeded from capturing debris effectively. To address these and other concerns, an embodiment exists in which the louvres 306 and the slots 305 have a predetermined amount of draft or taper therein, so that they may remain sufficiently loose to freely travel vertically, but not rotate or spin within the enclosure.

Figure 8:
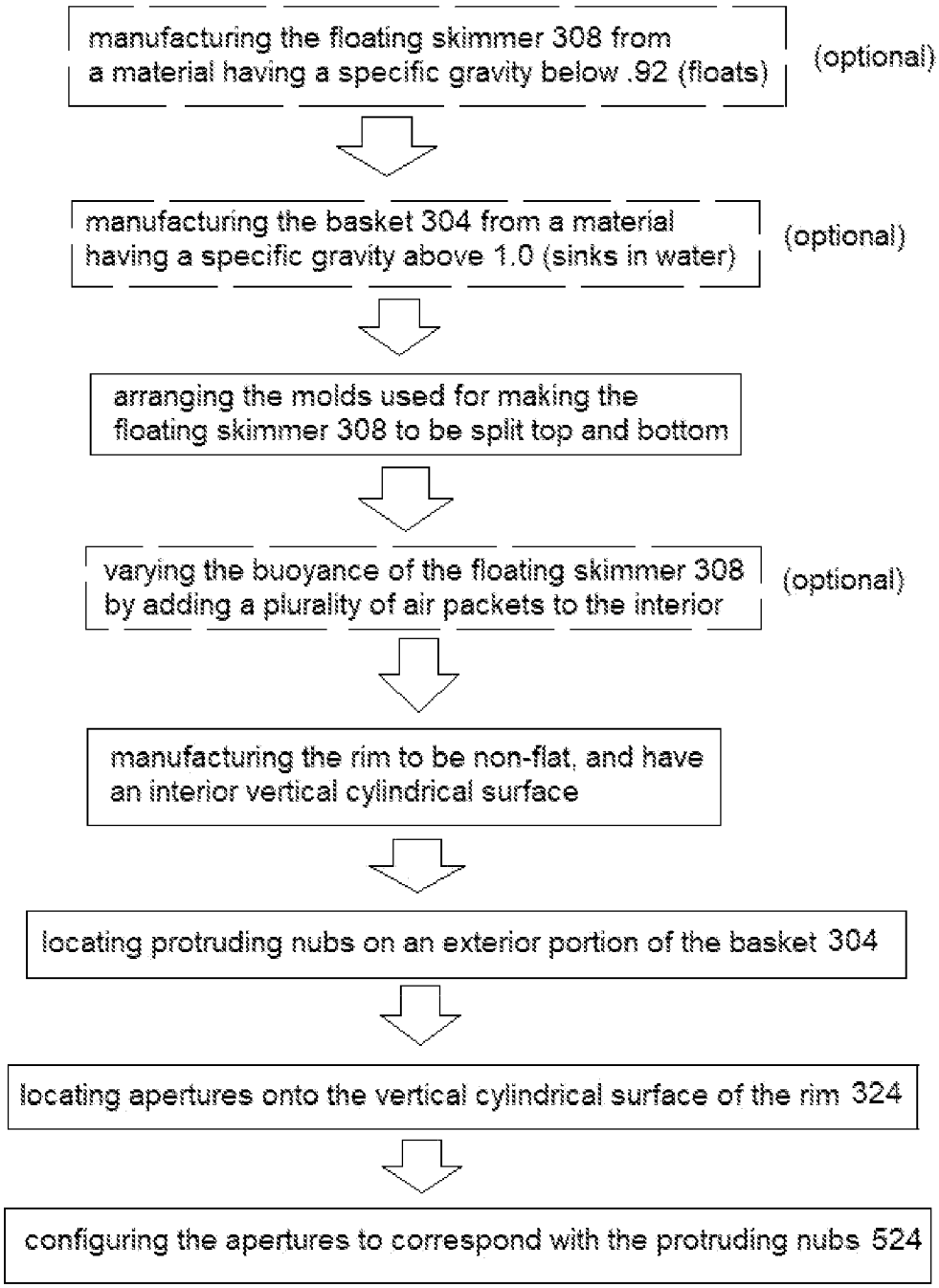
FIG. 8 shows an example flowchart comprising some potential manufacturing steps.

FIG. 8 shows an example flowchart comprising some potential steps to take in manufacturing various of the embodiments herein.

Figure 9:
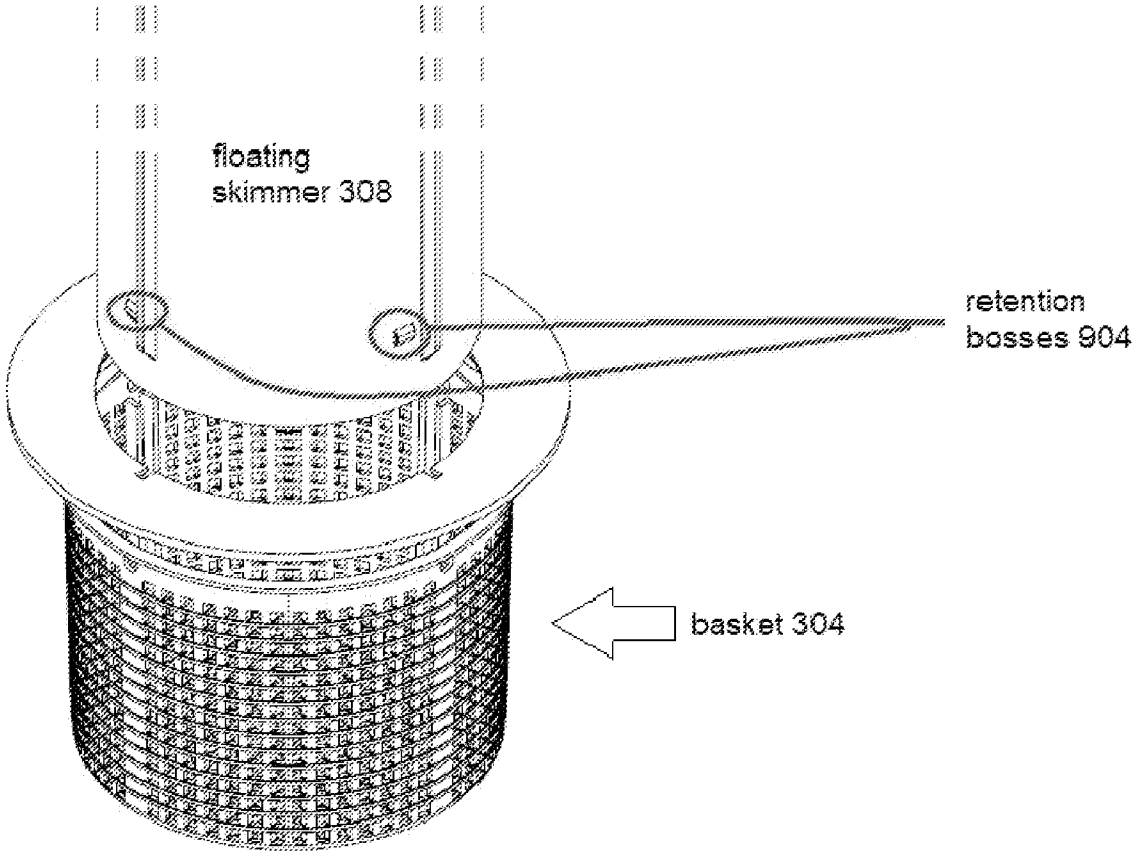
FIG. 9 shows example retention bosses with the floating skimmer.

FIG. 9 shows example retention bosses 904, suitable for preventing the floating skimmer 308 from entirely escaping the basket 304. This might occur during periods of high turbulence, such as when there is a large number of occupants in the pool.

Handle 320

The embodiments herein strive to reduce spinning and "shudder" of the system 300. That is, when the handle 320 attempts to rotate out of its intended position. One way to achieve this is making the handle 320 to take up 90° ($\pi/2$ radians, or one-quarter) of the circular surface at top of the system 300. This makes the handle 320 less subject to the forces of turbulence.

This also means the handle 320 can be located in four different quadrants e.g. N, S, E, or W, depending on user needs and the type of surface debris occurring.

The finger holes 332 are shown as a certain size. There is advantage to varying their size and contour. The finger holes 332 perform a dual-purpose, providing both quick easy access, but also provide some flow management. Within some pool skimmer devices, the "shudder" or lateral movement or precession makes attracting debris slightly reduced. Some of the shudder may cause floating debris to move away rather than towards the floating skimmer 308. This shudder, to the extent it exists, is addressed by the handle 320 being designed to occupy only a limited portion of the circular surface at top of the system 300. The example of 90° ($\pi/2$ radians, one-quarter) of the circular surface is but one example, numerous other sizes could be possible.

Air Chambers 704

Figure 7A:
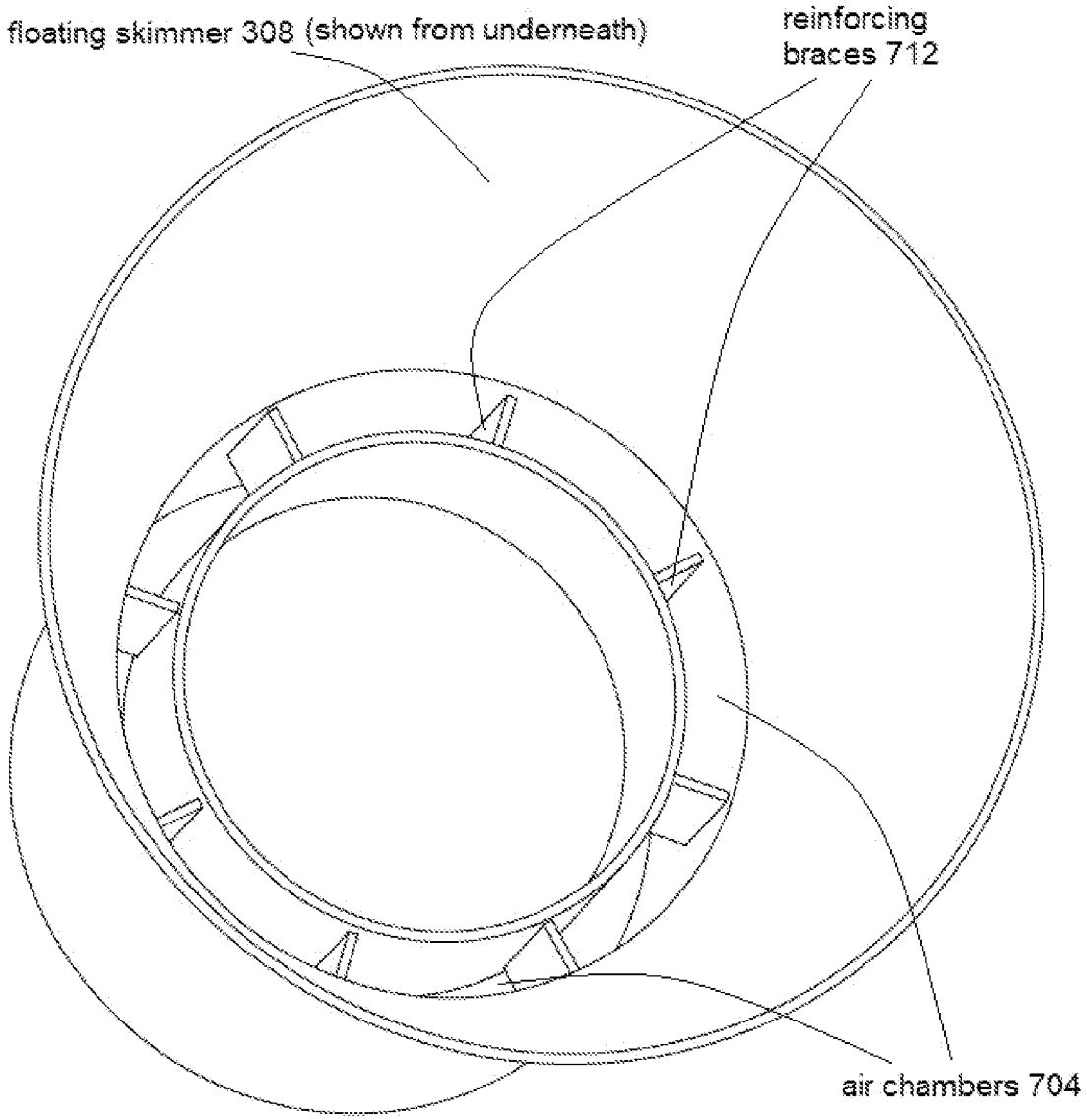
FIGS. 7A, 7B, and 7C show potential configurations of an interior of the floating skimmer.
Figure 7B:
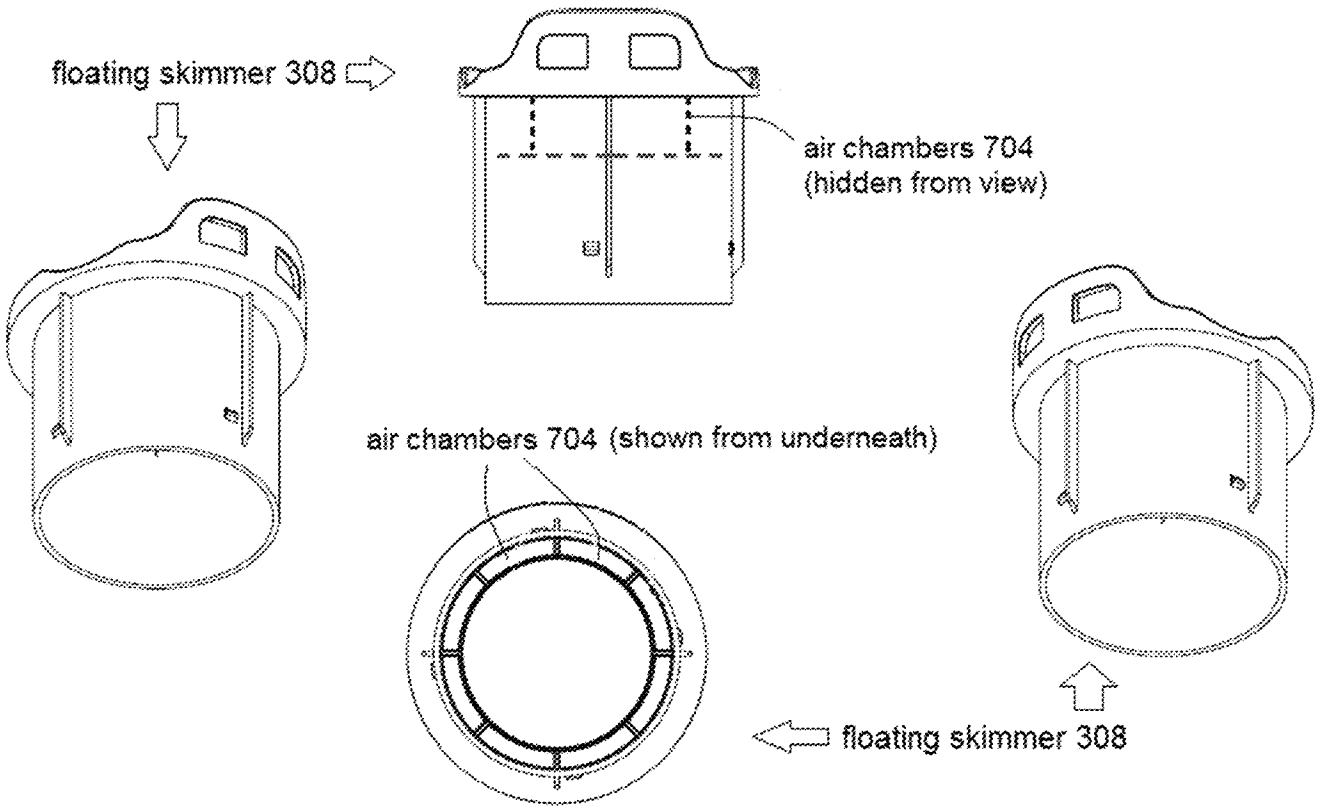
Figure 7C:
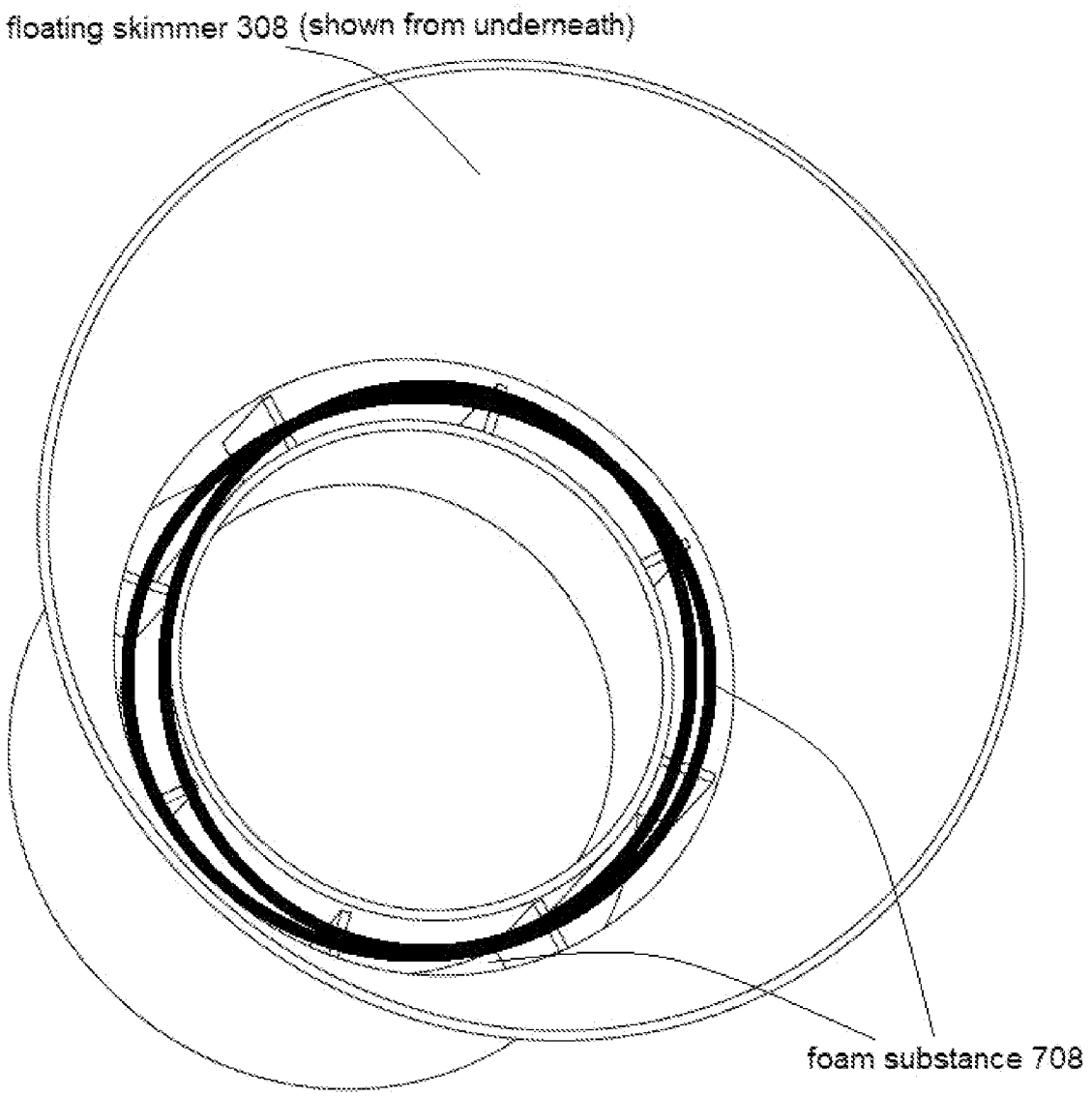

As shown at least within FIGS. 7A-7B, an interior of the movable section 308 comprises air chambers 704. As shown in FIG. 7C, it is also possible to include a foam substance 708 in the chosen location within the floating skimmer 308 instead of the air chambers 704.

FIGS. 7A-7B shows a variety of views of the air chambers 704. The air chambers 704 provide buoyancy and continually urge the movable portion in an upward direction. However, a plurality of reinforcing braces 712 within the air chambers 704 also assist in the strength and durability of the floating skimmer 308. Further, during period of water turbulence such as when the pool is occupied, the air chambers 704 act as a stabilizing force, help to manage or buffer the turbulence, and continue to capture surface debris. The air chambers 704 help the system 300 stay in place more effectively. The air chambers 704 are designed to prevent air from being pushed out.

Disclaimer

While preferred embodiments of the present invention have been shown and described herein, it will be obvious to those skilled in the art that such embodiments are provided by way of example only. It is not intended that the invention be limited by the specific examples provided within the specification. While the invention has been described with reference to the aforementioned specification, the descriptions and illustrations of the embodiments herein are not meant to be construed in a limiting sense. Numerous variations, changes, and substitutions will now occur to those skilled in the art without departing from the invention. Furthermore, it shall be understood that all aspects of the invention are not limited to the specific depictions, configurations, or relative proportions set forth herein which depend upon a variety of conditions and variables. It should be understood that various alternatives to the embodiments of the invention described herein may be employed in practicing the invention. It is therefore contemplated that the invention shall also cover any such alternatives, modifications, variations, or equivalents. It is intended that the following claims define the scope of the invention and that methods and structures within the scope of these claims and their equivalents be covered thereby.

What is claimed is:

1. A method of manufacturing a skimmer system, comprising:

configuring a cylindrical basket having a first diameter;

configuring a cylindrical floating skimmer having a second diameter and having a plurality of louvres defined along an exterior of the floating skimmer;

arranging the first diameter to be larger than the second diameter;

the louvres along the floating skimmer corresponding with a plurality of slots within the basket, the plurality of slots corresponding with a vertical axis of the floating skimmer, wherein the floating skimmer float-travels along the vertical axis;

a concentric rim projecting horizontally from the basket and surrounding the basket;

wherein as the floating skimmer goes up and down with the louvres traveling inside of the slots, the rim being always near to or at the same level as a surface of pool water.

2. The method of claim 1, further comprising:

configuring the floating skimmer with a plurality of air chambers within an interior.

3. The method of claim 2, further comprising:

equipping the air chambers with a plurality of reinforcing braces.

4. The method of claim 3, further comprising:

configuring the floating skimmer with a handle.

5. The method of claim 4, further comprising:

configuring the handle with a plurality of flow channels.

6. The method of claim 4, further comprising:

configuring the handle with a plurality of finger holes.

7. The method of claim 6, further comprising:

configuring the handle to occupy 90° ($\pi/2$ radians, one-quarter) of the circular surface at top of the system.

8. The method of claim 7, further comprising:

packaging and shipping the system with two unequal-sized rims;

the two unequal-sized rims matching with known sizes of skimming infrastructure apertures; thereby allowing a user to select the proper-sized rim for a pool aperture.

9. The method of claim 8, further comprising:

configuring an upper-surface of one of more of the plurality of flow channels with a contour-lip.

10. The method of claim 8, further comprising:

configuring one or more of the plurality of flow channels to have inserts for entirely replacing a bevel via a snap-in piece.

11. The method of claim 8, further comprising:

configuring a vertical surface within one or more of the plurality of flow channels to have a moving or non-rigid surface.

12. The method of claim 8, further comprising:

configuring the basket to be locatable in one of four different quadrants of a skimmer enclosure, depending on user needs and a type of surface debris occurring within a pool.

13. The method of claim 6, further comprising:

manufacturing the rim and basket to have snap-on features.

14. The method of claim 13, further comprising:

positioning a plurality of protruding nubs on the rim;

positioning a plurality of apertures on the basket; and the plurality of protruding nubs corresponding with the plurality of apertures.

15. The method of claim 14, further comprising:

configuring the basket from non-buoyant PVC.

16. The method of claim 15, further comprising:

configuring the basket from material with a specific gravity above 1.3.

17. The method of claim 15, further comprising:

configuring the floating skimmer from a material differing from that which comprises the basket.

18. The method of claim 17, further comprising:

configuring the floating skimmer from a material having positive buoyancy.

19. The method of claim 17, further comprising:

configuring the floating skimmer from polypropylene.

20. The method of claim 17, further comprising:

configuring the floating skimmer of a material having a specific gravity below 0.92.

* * * * *